US006041760A

United States Patent [19]

Fehlmann et al.

[11] Patent Number: 6,041,760

[45] Date of Patent: Mar. 28, 2000

[54] FUEL INJECTION PUMP WITH AN INJECTION ADJUSTER PISTON USED TO ADJUST THE ONSET OF INJECTION

[75] Inventors: Wolfgang Fehlmann, Stuttgart; Thomas Kulder, Steinheim, both of Germany

[73] Assignee: Robert Bosch GmbH, Stuttgart, Germany

[21] Appl. No.: 09/068,793

[22] PCT Filed: Jun. 17, 1997

[86] PCT No.: PCT/DE97/01225

§ 371 Date: May 18, 1998

§ 102(e) Date: May 18, 1998

[87] PCT Pub. No.: WO98/14695

PCT Pub. Date: Apr. 9, 1998

[30] Foreign Application Priority Data

Oct. 2, 1996 [DE] Germany ..... 196 40 678

[51] Int. Cl.[7] ..... F02M 37/04

[52] U.S. Cl. ..... 123/502

[58] Field of Search ..... 123/500, 501, 123/502

[56] References Cited

U.S. PATENT DOCUMENTS

| | | | |
|---|---|---|---|
| 5,638,794 | 6/1997 | Kuba et al. | 123/502 |
| 5,655,502 | 8/1997 | Enomoto | 123/502 |
| 5,769,056 | 6/1998 | Greiger et al. | 123/502 |
| 5,889,733 | 3/1999 | Kubo et al. | 123/502 |

*Primary Examiner*—Thomas N. Moulis

*Attorney, Agent, or Firm*—Edwin E. Greigg; Ronald E. Greigg

[57] ABSTRACT

A fuel injection pump for adjusting the injection onset by an injection adjuster piston. The piston is embodied as a follower piston of a control slide disposed in the piston on one side the piston encloses a work chamber and is acted upon by the pressure in this work chamber counter to the force of a restoring spring, and is connected to a substantially stationary part of a cam drive of the fuel injection pump. To avoid feedback of pressure surges on the control slide and its adjustment, the inlet cross section of the connecting line is embodied as an elongated cross section extending in the displacement direction of the control slide. A more problem-free adjustment of the control slide is thus obtained, and hence also a more-precise, vibration-free adjustment of the injection adjuster piston and of the injection onset is obtained.

8 Claims, 2 Drawing Sheets

FUEL INJECTION PUMP WITH AN INJECTION ADJUSTER PISTON USED TO ADJUST THE ONSET OF INJECTION

PRIOR ART

The invention is based on a fuel injection pump including an injection adjuster piston used to adjust an onset of injection. In one such fuel injection pump, known from German Patent Disclosure DE-A1 35 32 715, an axially parallel blind bore that begins at the face end of the injection adjuster piston remote from the work chamber is provided as a connecting line between the work chamber and the cylinder bore; on its end, this blind bore is intersected by a transverse bore extending radially from the outside to the cylinder bore. The cross section of this transverse bore where it enters the cylinder bore has a circular area.

In this kind of injection adjusting device, the problem arises that because of the load change in the cam drive of the fuel injection pump, pressure fluctuations occur in the region of the pressure chambers of the injection adjuster, or relative motions between the injection adjuster piston and the control slide.

ADVANTAGES OF THE INVENTION

By means of the fuel injection pump of the invention, the advantage is attained that when relative displacements of the control slide occur, initially only a small cross-sectional area is opened, which for the same adjustment distance is smaller than the usual cross-sectional area established when the inlet cross section of the connecting line into the cylinder bore is circular. Thus, whenever because of relative motion between the injection adjuster piston and the control slide, the control slide is briefly adjusted out of its intrinsically correct position relative to the injection adjuster piston, only a very small throttling cross section is opened up, so that the mispositioning of the control slide is not immediately as a substantial change in pressure in the work chamber of the injection adjuster piston. This averts a fast, forceful reaction on the part of the injection adjuster piston to the brief mispositioning of the control slide in such a way that incorrect vibrating or oscillating positions of this kind cannot be amplified to cause further vibration or oscillation of the injection adjuster piston.

Advantageous refinements of the embodiment of the inlet cross section of the connecting line into the cylinder bore are recited hereinafter. It is essential to attain a quasi-continuous course of the cross section with a steady adjustment of the control edge that controls this cross section; the increase in cross section is effected over a relatively long adjustment distance. In the open position, the full overflow cross section is then available, so that in an intentional adjustment of the control slide, a correction of the injection adjuster piston position can be made with the requisite speed.

In a further advantageous feature, the adjustment of the control slide is effected in a manner known per se by means of an actuator, which in a part of the injection adjuster structurally connected to the housing encloses a pressure chamber with a surface acted upon by the control pressure. Because of this pressure chamber accommodated outside the injection adjuster piston, a decoupling of this pressure chamber from the pressure fluctuations in the work chamber of the injection adjuster piston is achieved, especially by means of the relief chamber located between the two. This provision as well, in a supplement to the embodiment defined herein, contributes to reducing pressure oscillations of the injection adjuster piston.

BRIEF DESCRIPTION OF DRAWINGS

Different exemplary embodiment of the invention are shown in the drawing and will be described in further detail below.

DESCRIPTION OF THE EXEMPLARY EMBODIMENT

Figure 1:
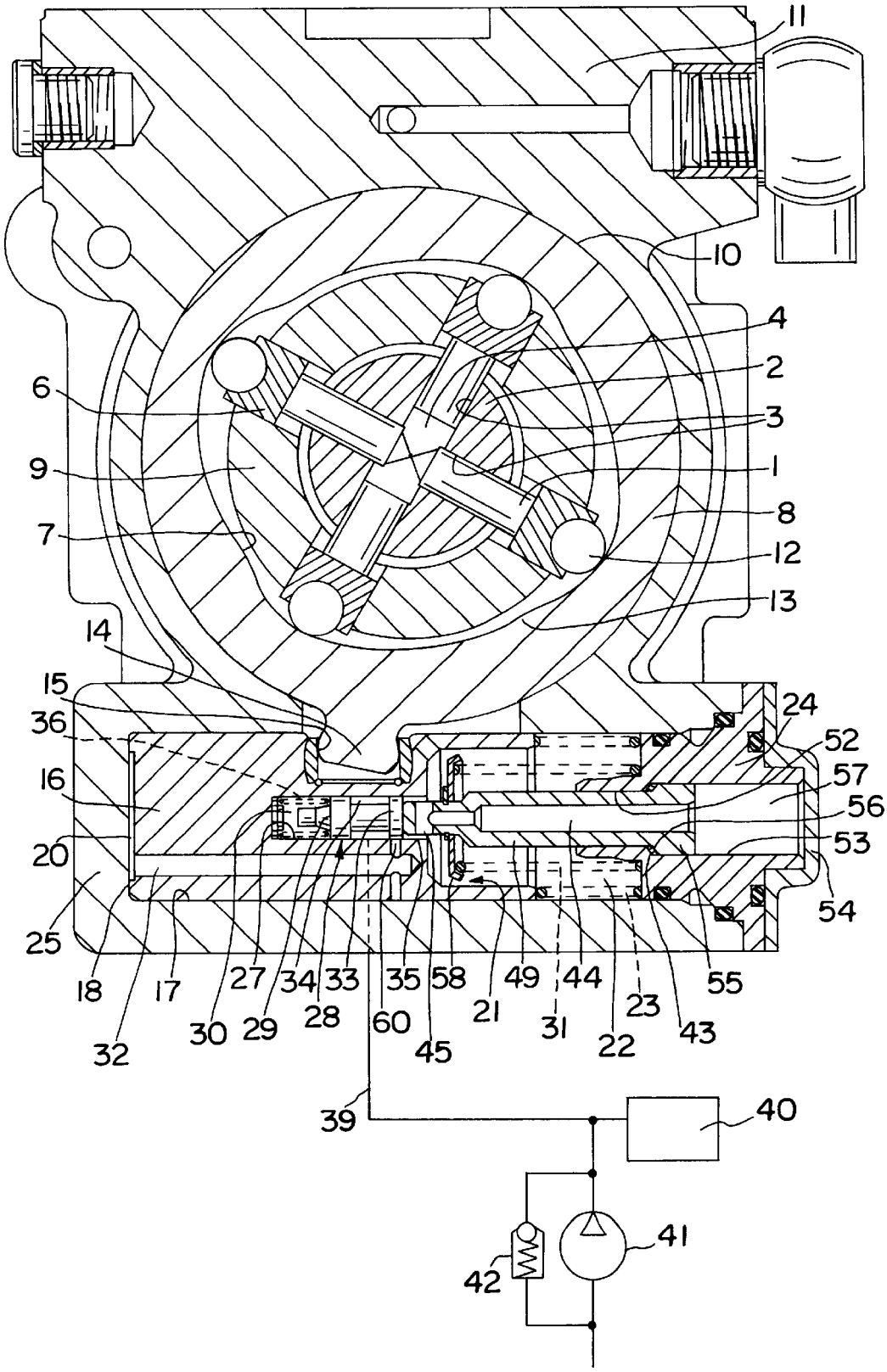
FIG. 1 shows a section through a fuel injection pump of the distributor type with radially located pump pistons and a device for injection onset adjustment, in the embodiment according to the invention.
Figure 2:
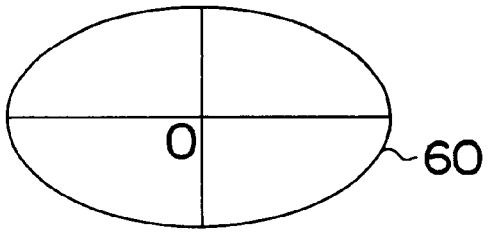
FIG. 2 illustrates a cross section of an elliptical inlet.

The fuel injection pumps of the distributor type may be provided with pumps either in the form of an axially driven pump piston acting as both a distributor and a pump piston, or with radial pistons which radially feed into a feed conduit disposed in a distributor. One such so-called radial piston pump of the known type is shown in section in FIG. 1. Four pump pistons 1 are provided, which are supported tightly displaceably in radial bores 3 of the distributor 2, at the same angular spacing in the same radial plane to the axis of the distributor 2. On one face end, the pump pistons enclose a common pump work chamber 4, which in a known manner, not shown in further detail here, is filled with fuel in the radially outward stroke of the pump pistons 1, and in the radial inward stroke of the pump pistons is made to communicate via a pressure line, also not visible here, with a distributor opening at the jacket face of the distributor 2; the distributor opening opens up injection lines that originate at the circumference of the distributor, each of which is supplied with fuel brought to injection pressure when the pump pistons are moving inward. By means not shown in further detail, the distributor is driven to rotate by a drive shaft in such a way that on the one hand the distributor opening is capable of performing its control function and on the other the pump pistons are moved in the circumferential direction. Roller tappets 6 rest on the side of the pump pistons opposite the pump work chamber 4 and follow a cam path 7 that is disposed on a cam ring 8, on its annular surface pointing inward toward the distributor. The cam ring 8 represents the substantially stationary part of the cam drive of the pump pistons. While the device, which moves the pump pistons and which for instance may be the ring that guides the roller tappets 6 and is coupled to the drive shaft, represents the moving part of the cam drive. Depending on the position of the cam ring, which is guided with its cylindrical outer wall in a corresponding cylindrical recess 10 of the pump housing 11 of the fuel injection pump, an earlier or later runup of the rollers 12 of the roller tappets 6 onto the respective cam 13 is brought about, the cams being arranged such that all the roller tappets are moved synchronously inward or outward by the same stroke lengths. With the adjustment of the cam ring, the onset of the supply stroke of the pump pistons and thus the injection onset are thus varied in proportion to the drive of the fuel injection pump.

For the adjustment, the cam ring 8 has a lug 14, which engages a recess 15 in an injection adjuster piston 16, on the cylindrical jacket face thereof. The injection adjuster piston is tightly displaceable in a cylinder 17 and with one face end 18 and the closed end of the cylinder 17 it encloses a work chamber 20, while with its opposite other end face, in the likewise closed cylinder there, it encloses a spring chamber 22. Disposed in this spring chamber is a restoring spring 23, which is supported at one end on a closure part 24 that closes off the cylinder 17 and on the other on the face end 21 of the adjusting piston 16 and, thus fastened in place, seeks to cause one face end 18 of the injection adjuster piston 16 to contact the wall 25 that closes the cylinder 17 opposite it.

Also provided in the injection adjuster piston 16 is an axial blind bore 27, in the form of a cylinder bore that guides a control slide 28 and opens toward the spring chamber 22. With one face end 29 and the closed end of the cylinder bore, the control slide 28 inserted into the spring chamber encloses a chamber 30, in which a compression spring 36 axially loads the control slide, and with its other end protrudes into the spring chamber 22, where it is acted upon by a control spring 31 that on the other end is likewise supported on the closure part 24.

Extending in the adjusting piston parallel to the cylinder bore 27 is a connecting line 32, which begins on one face end 18 and discharges into the cylinder bore radially in the region of overlap by the control slide. This discharge point can be closed by an annular collar 33 of the control slide; this annular collar separates an annular groove 34 located toward the work chamber from an annular chamber 35, and a pressure fluid inlet discharges into the annular groove 34 while the annular chamber 35 discharges into the spring chamber 32, which is relieved via a relief line, not shown. The annular edges defining the annular collar are control edges, by means of which, upon a relative displacement of the control slide, the connecting line 32 is either made to communicate with the pressure fluid inlet 39 via the annular groove 34 or relieved via the annular chamber 35 toward the spring chamber 22. The annular groove 34 is constantly in communication with the pressure fluid inlet 39, which is supplied with pressure fluid from a pressure storage chamber 40. To supply the storage chamber, a fuel pump 41 with a parallel-connected pressure control valve 42 is used; by them together the pressure storage room is supplied in a known manner with a pressure that increases substantially as a function of rpm with increasing rpm of the fuel injection pump or of the associated internal combustion engine.

The adjustment of the control slide is effected with the aid of a tappet 49, with which the control slide is coupled under the influence of the compression spring 36, so that on the end of the control slide protruding into the spring chamber 22, the control slide comes into contact with the tappet 49. The tappet extends coaxially to the axis of the adjusting piston 16 or of the control slide 28, and on the side opposite the face end 21 of the control slide, it enters an axial bore 52 provided in the closure part 24. A closed work cylinder 53 is disposed in the closure part 24; it coaxially adjoins the axial bore 52, and on its other end is closed by a cap 54. In the work cylinder, a piston 55 embodied on the end of the tappet 49 is displaceably disposed; on one end, pointing toward the spring chamber 22, it encloses a pressure chamber 56, and on its other end, between the piston 55 and the cap 54, it encloses a relieved chamber 57, which via an axial bore 44, which changes over into a transverse bore 45 and communicates constantly with the spring chamber. Also connected to the tappet 49 in the region of the spring chamber is a spring plate 58, between which and the closure part 24 a control spring 31 is supported, against which the tappet 49 is displaced under the influence of a control pressure introduced into the pressure chamber 56. The aforementioned rpm-dependent pressure serves as the control pressure.

In a displacement to the right of the control slide by the tappet 49, which occurs as the control pressure rises, the annular collar 33 executes a controlling function such that the work chamber 20 is supplied with pressure fluid until such time as the connecting line 32, which was previously opened, is closed again by an ensuing motion of the adjusting piston 16 counter to the force of the spring 23. Conversely, if the pressure in the pressure chamber 56 drops, the work chamber 20 is relieved until such time as the connecting line is closed again. The pressure in the pressure chamber 56 may also be relieved or modified by means of a relief line 43, in which an electrically controlled valve 44 is seated.

In this known device for injection onset adjustment, the problem arises that via the rollers 12, feedback forces upon drive of the pump pistons are transmitted to the cam ring 8, and the are carried in turn to the injection adjuster piston 16, so that the pressure in the work chamber increases in surges. This pressure is then also applied to the annular collar 33, by way of which, upon oscillatory motions of the control slide relative to the injection adjuster piston, fuel can also get into the chamber 20 and cause increases in pressure there, which in turn have feedback effects on the position of the control slide. This leads to an unstable behavior of the injection adjuster piston or of the entire device for injection onset adjustment.

Figure 3:
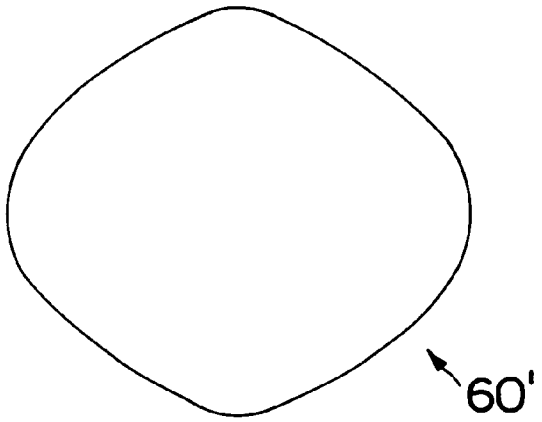
FIG. 3 illustrates a cross section of a parabolic inlet.
Figure 4:
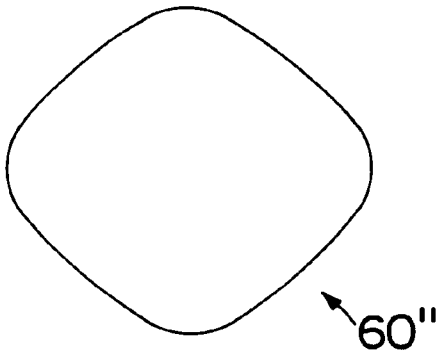
FIG. 4 illustrates a cross section of a hyperbolic inlet.

To avoid these disadvantages, the entry 60 of the connecting line 39 into the cylinder bore 27 is provided with an elongated, preferably elliptical cross section with its main length located in the displacement direction of the control slide, so that upon a displacement of the control slide relative to the injection adjuster piston, by means of the control edge of the annular collar at first only a small throttling cross section toward the work chamber 20 is opened up. Thus; if vibration or oscillation occurs, only a slight amount of pressure fluid can be delivered to the work chamber 20 or removed from it. This substantially reduces the tendency to vibration in response to such disturbing forces as engine surges. Instead of an elliptical cross section, other cross-sectional courses that reinforce this action may be realized at the opening of the inlet cross section of the pressure fluid inlet. To that end, composite parabola segments 60' as shown in FIG. 3; or hyperbola segments 60" as shown in FIG. 4 can be named, or other boundaries of the cross sectional area in the form of conical section curves.

This feature is especially advantageous in conjunction with the pressure chamber 56 structurally connected to the housing as described above and located outside the injection adjuster piston. With this arrangement, the occurrence of vibration or oscillation in response to impacts transmitted by the cam drive is additionally avoided, since this pressure chamber, via the relieved spring chamber, is uncoupled from the impact-encumbered pressure side and the resultant motions of the injection adjuster piston.

The foregoing relates to preferred exemplary embodiments of the invention, it being understood that other variants and embodiments thereof are possible within the spirit and scope of the invention, the latter being defined by the appended claims.

We claim:

1. A fuel injection pump having an injection adjuster piston (16) that serves to adjust an onset of injection, said piston operates in a cylinder (17) that defines a work chamber (20) that is acted upon by a controllable pressure fluid that adjusts an injection adjuster piston counter to a restoring force, a control slide (28) is disposed displaceably in an axial direction of the injection adjuster piston (16) in a cylinder bore (27), the cylinder bore is closed on one end, of the injection adjuster piston (16) and is adjustable by a control pressure counter to a force of a control spring (31), and which with control edges in the cylinder bore (27) controls a communication of a connecting line (32) from the cylinder bore (27) to the work chamber (20) with a pressure fluid inlet (39) into the cylinder bore (27) or a pressure fluid outlet (35) out of the cylinder bore, the inlet cross section (60) of the connecting line (32) into the cylinder bore (27), controlled by the control edge of the control slide (28), is embodied as an elongated cross section extending in the displacement direction of the control slide.

2. A fuel injection pump in accordance with claim 1, in which the cross section is embodied elliptically.

3. A fuel injection pump in accordance with claim 1, in which the cross section is embodied parabolically.

4. A fuel injection pump in accordance with claim 1, in which the cross section is embodied hyperbolically.

5. A fuel injection pump in accordance with claim 1, in which an actuator (49, 55) effecting an adjustment of the control slide (28) has a surface acted upon by the control pressure, and the actuator (49, 55) protrudes with this surface into a pressure chamber (56) that is separate from the work chamber (20) and is disposed in a part (24) structurally connected to the housing, and a relief chamber (22) is disposed between the pressure chamber (56) and the work chamber (20) of the injection adjuster piston (16), which relief chamber is defined by the face end (21) of the injection adjuster piston (16), and the work chamber (20) is disposed on the side of the injection adjuster piston (16) opposite the relief chamber (22).

6. A fuel injection pump in accordance with claim 2, in which an actuator (49, 55) effecting an adjustment of the control slide (28) has a surface acted upon by the control pressure, and the actuator (49, 55) protrudes with this surface into a pressure chamber (56) that is separate from the work chamber (20) and is disposed in a part (24) structurally connected to the housing, and a relief chamber (22) is disposed between the pressure chamber (56) and the work chamber (20) of the injection adjuster piston (16), which relief chamber is defined by the face end (21) of the injection adjuster piston (16), and the work chamber (20) is disposed on the side of the injection adjuster piston (16) opposite the relief chamber (22).

7. A fuel injection pump in accordance with claim 3, in which an actuator (49, 55) effecting an adjustment of the control slide (28) has a surface acted upon by the control pressure, and the actuator (49, 55) protrudes with this surface into a pressure chamber (56) that is separate from the work chamber (20) and is disposed in a part (24) structurally connected to the housing, and a relief chamber (22) is disposed between the pressure chamber (56) and the work chamber (20) of the injection adjuster piston (16), which relief chamber is defined by the face end (21) of the injection adjuster piston (16), and the work chamber (20) is disposed on the side of the injection adjuster piston (16) opposite the relief chamber (22).

8. A fuel injection pump in accordance with claim 4, in which an actuator (49, 55) effecting an adjustment of the control slide (28) has a surface acted upon by the control pressure, and the actuator (49, 55) protrudes with this surface into a pressure chamber (56) that is separate from the work chamber (20) and is disposed in a part (24) structurally connected to the housing, and a relief chamber (22) is disposed between the pressure chamber (56) and the work chamber (20) of the injection adjuster piston (16), which relief chamber is defined by the face end (21) of the injection adjuster piston (16), and the work chamber (20) is disposed on the side of the injection adjuster piston (16) opposite the relief chamber (22).

* * * * *